US005433574A

United States Patent [19]

Kawano et al.

[11] Patent Number: 5,433,574

[45] Date of Patent: Jul. 18, 1995

[54] GAS PURGE UNIT FOR A PORTABLE CONTAINER

[75] Inventors: Hitoshi Kawano; Teppei Yamashita; Masanao Murata; Tsuyoshi Tanaka; Teruya Morita; Atsushi Okuno; Mitsuhiro Hayashi; Akio Nakamura, all of Ise, Japan

[73] Assignee: Shinko Electric Co., Ltd., Tokyo, Japan

[21] Appl. No.: 364,003

[22] Filed: Dec. 27, 1994

Related U.S. Application Data

[63] Continuation of Ser. No. 64,583, May 21, 1993, abandoned.

[30] Foreign Application Priority Data

May 21, 1992 [JP] Japan ..... 4-128850

[51] Int. Cl.[6] ..... B65B 1/04

[52] U.S. Cl. ..... 414/217; 414/940; 414/416

[58] Field of Search ..... 414/217, 416, 940, 331

[56] References Cited

U.S. PATENT DOCUMENTS

| | | | |
|---|---|---|---|
| 4,532,970 | 8/1985 | Tullis et al. | 141/98 |
| 4,534,389 | 8/1985 | Tullis | 141/98 |
| 4,616,683 | 10/1986 | Tullis et al. | 414/217 |
| 4,724,874 | 2/1988 | Parikh et al. | 414/414 |
| 4,995,430 | 2/1991 | Bonora et al. | 414/217 |
| 5,169,272 | 12/1992 | Bonora et al. | 414/217 |

FOREIGN PATENT DOCUMENTS

| | | |
|---|---|---|
| 0313693 | 5/1989 | European Pat. Off. . |
| WO-A-90 14273 | 11/1990 | WIPO . |
| WO-A-92 07759 | 5/1992 | WIPO . |

*Primary Examiner*—Michael S. Huppert
*Assistant Examiner*—Thomas J. Brahan
*Attorney, Agent, or Firm*—Bacon & Thomas

[57] ABSTRACT

A gas purge unit for a portable closed container is defined by a purge box including an opening, and a container stand around the opening on which a closed container is set; a gas supplying inlet coupled to a gas supplying source, and a gas discharging outlet; and a lifting mechanism for closing the opening from inside of the purge box and controlling the locking and unlocking operations of a locking mechanism provided in the lid of the container.

5 Claims, 2 Drawing Sheets

GAS PURGE UNIT FOR A PORTABLE CONTAINER

This application is a Continuation of application Ser. No. 08/064,583, filed May 21, 1993, now abandoned.

BACKGROUND OF THE INVENTION

1. Field of the Inparticlerial Application

This invention relates to a gas purge unit for a portable container which is suitably used in a clean room employed for instance in the manufacture of semiconductors.

2. Description of the Prior Art

Semiconductors are manufactured, for instance, in a clean room, the atmosphere in which has been purified. In the manufacture, in order to eliminate the difficulty that particles stick on the semiconductor wafers, the semiconductor wafers are conveyed as follows: The semiconductor wafers are set in a wafer cassette, and the wafer cassette is loaded in a closed container. That is, the closed container accommodating the semiconductor wafers is conveyed.

Recently, semiconductors have been improved in performance, and increased in the degree of integration. Therefore, pollution of the surfaces of semiconductor wafers, that is, formation of native oxide film on them by oxygen and moisture in the air has been a serious problem in one of the semiconductor manufacturing steps. In order to prevent the pollution, a gas purge method has been employed in which the atmosphere in the closed container is replaced with a gas inactive with the wafers, such as nitrogen gas or refined dry air.

On the other hand, in a semiconductor manufacturing equipment such as a CVD/diffusion equipment, a gas purge operation using a gas such as nitrogen gas has been employed because of the following reason. In the CVD/diffusion equipment, a semiconductor film is formed in the furnace at high temperature. If air (oxygen) is drawn in the furnace when the wafer is conveyed into the furnace, then an unwanted film is formed, thus decreasing the performance of the resultant semiconductor. In this connection, it should be noted that the gas purge operation is carried out only when the wafer is moved from the closed container to the manufacturing equipment.

Purging the closed container of gas in the operation of the CVD/diffusion equipment will be described in more detail.

FIG. 3 shows the conveyance of the wafers from the closed container to the CVD furnace. The inside of the manufacturing equipment 201 has been filled with nitrogen gas, while the closed container 101 conveyed to it has been filled with air (oxygen). Therefore, after the air in the closed container 101 is replaced with nitrogen gas, the wafer cassette 102 is taken out of the container 101. The wafer cassette 102 is set on a shelf 202 in the equipment by a cassette handling device 207. Under this condition, a wafer placing device 203 operates to take the wafers out of the wafer cassette one (or more than one) at a time, and place them in a quartz boat 204. The quartz boat 204 with the wafers is lifted to the CVD furnace by a boat lifting device 205, where they are loaded in a quartz tube 206.

As compared to the above-described wafer portable operation, the invention concerns the process of replacing the oxygen gas in the closed container with nitrogen gas, and a method of preventing the oxygen gas in the closed container from flowing into the equipment. As shown in FIG. 3, the inside of the equipment is partitioned with a port skirt 103 at one corner, and in addition to the port skirt 103, a coil spring 104 for lifting a port door 105, a bellows 106, an elevator 107, etc. are provided, and a nitrogen gas inlet 108 and a nitrogen gas outlet 109 are provided in such a manner that they penetrate a port plate 110 radially. Additonally, reference numeral 111 designates seal rings; and 112, a lid. In the equipment thus constructed, the air therein is replaced with a nitrogen gas as follows:

(1) When the closed container 101 is set on the port 110, a sensor (not shown) operates to activate the elevator 107, so that the bottom lid of the closed container 101 is disengaged from the container body, and moved downwardly with the port door 105.

(2) As a result, the port skirt 103 and the container 101 form a closed space, and the nitrogen gas inlet and outlet are communicated with the closed space A; i.e., the inside of the container 101. Under this condition, the nitrogen gas is forcibly supplied into the container 101, so that the air in the container 101 is replaced with the nitrogen gas.

(3) Thereafter, the port door 105 is lowered to a predetermined wafer cassette 102 transferring position, where the wafer cassette 102 is handled by the cassette handling device 207 of the manufacturing equipment 201.

In the case where the closed container 101 filled with the inert gas is used for conveyance and storage of the wafer cassette 102, sometimes the nitrogen gas leaks from the container 101 during conveyance or storage, so that its concentration becomes lower than a predetermined value.

In this case, since the gas purge operation is carried out only by the above-described manufacturing equipment, the container 101 is returned to the equipment during conveyance or storage so that it is purged of gas. This is not economical, and makes the management of the close container 101 troublesome.

As was described above, the gas purge mechanism of the manufacturing equipment 201 needs intricate means such as the skirt 103, the bellows 106, the coil spring 104, the seals 111, etc. in order to prevent the air (oxygen) or contaminated gas in the closed container 101 from flowing into the equipment 201 during the gas purge operation. On the other hand, the gas purge mechanism is not suitable as means for maintaining the closed container 101 filled with nitrogen gas, because its original purpose of use is to convey the wafer cassette 102 into the equipment, and the mechanism is unavoidably bulky because of its large vertical stroke.

SUMMARY OF THE INVENTION

Accordingly, an object of this invention is to eliminate the above-described difficulties accompanying a conventional gas purge mechanism. More specifically, an object of the invention is to provide a gas purge unit small in size, simple in structure, low in manufacturing cost and high in performance which can be readily installed at a desired position in a clean room.

The foregoing object of the invention has been achieved by the provision of a gas purge unit for a portable closed container comprising: a purge box having an opening, and a container stand around the opening on which a closed container is set; a gas supplying inlet coupled to a gas supplying source, and a gas discharging outlet; and lifting means for closing the opening from inside of the purge box and controlling the locking and unlocking operations of a locking mechanism provided in the lid of the container.

In the gas purge unit of the present inventoion, the gas supplying inlet and the gas discharging outlets are opened in the wall of the opening and in the wall of the box, and when the container is purged of gas, the lid of the container is unlocked, and lowered slightly together with the lifting means so that the purge box is communicated with the inside of the container.

The gas purge unit of the invention is provided as one unit, and can be handled with ease. Therefore, it can be installed at desired positions in the clean room, or on devices in the clean room.

DETAILED DESCRIPTION OF THE PREFERRED EMBODIMENT

One preferred embodiment of this invention will be described with reference to the accompanying drawings.

Figure 1:
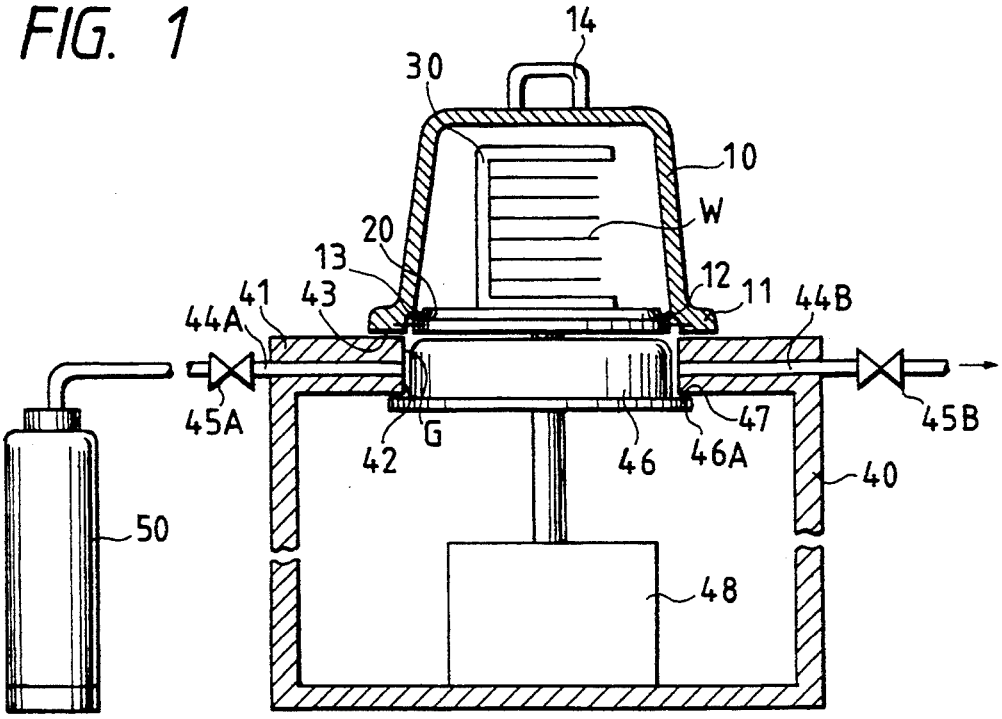
FIG. 1 is a longitudinal sectional view of one example of a gas purge unit according to this invention.

In FIG. 1, reference numeral 10 designates the body of a portable closed container (pod) (hereinafter referred to as "a container body", when applicable); 11, a flange defining the opening 12 of the container body; 13, a seal ring; 14, a handle; 20, the lid of the closed container; 30, a wafer cassette, in which semiconductor wafers W are set; and 40, a gas purge box. The upper wall 41 of the gas purge box 40 has an opening 42, which is made as small as possible to increase the efficiency of the gas purge mechanism. A gas supplying pipe 44A is provided in the upper wall 41 in such a manner that its one end is open in the wall of the opening 42 and the other end is coupled to an inert gas cylinder 50 (a nitrogen gas cylinder in the embodiment). In addition, a gas discharging pipe 44B is provided in the upper wall 41 of the gas purge box 40 in such a manner that its one end is open in the wall of the opening 42 and the other end is open in the air, outside the box 40. The gas supplying pipe 44A has a gas supplying valve 45A, and the gas discharging pipe 44B has a gas discharging valve 45B. Nitrogen gas supplying sources are arranged at suitable positions in the clean room.

Further in FIG. 1, reference numeral 46 designates a lift stand. When the lift stand is engaged with the opening 42 of the upper wall of the box, there is formed a gap G between the lift stand 46 and the opening 42. The lift stand 46 has a flange 46A, which is extended outwardly from the edge of its lower surface, and has a seal ring 47 on it. Reference numeral 48 designates a lifting mechanism for lifting the lift stand 46.

Figure 2:
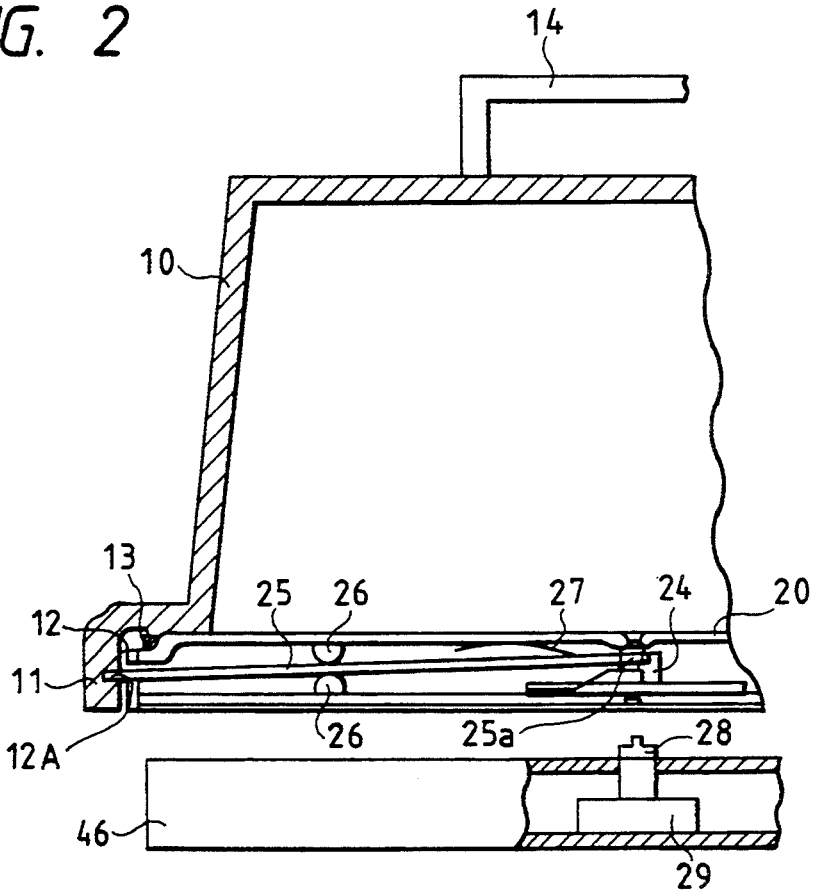
FIG. 2 is a sectional view for a description of a locking mechanism for a portable close container.
Figure 3:
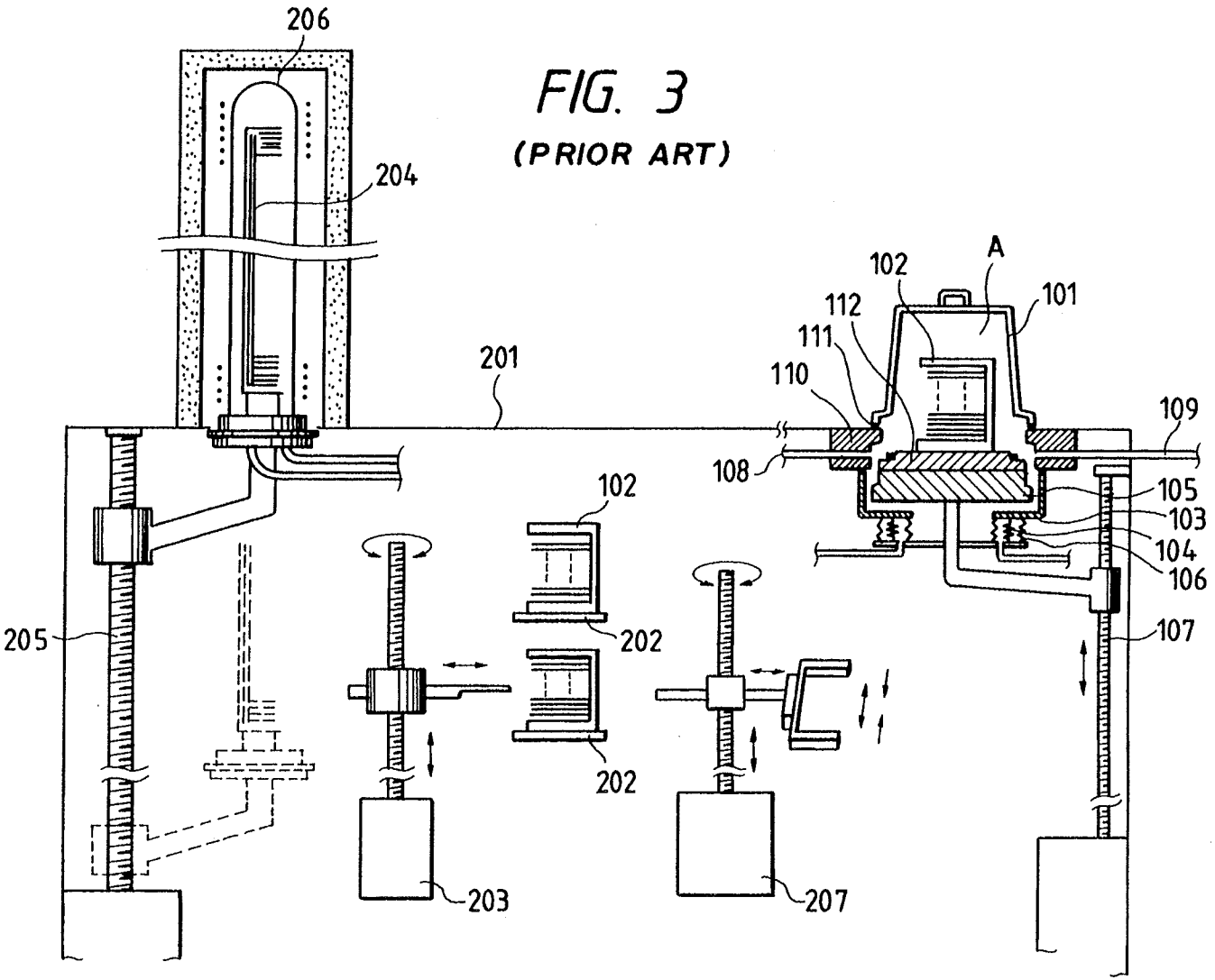
FIG. 3 (PRIOR ART)
FIG. 3 is a longitudinal sectional view for a description of a conventional gas purge method for a closed container.

The lid 20 of the closed container is hollow, and has a lock mechanism as shown in FIG. 2. In FIG. 2, reference numeral 24 designates a cam, and 25, a plate-shaped lock arm. The lock arm 25 has a roller **25*a*, and is cantilevered in such a manner that it is movable longitudinally and tiltable. Further in FIG. 2, reference numeral 26 designates a fulcrum member; 27, a spring; and 28, a cam shaft. The cam shaft 28 is extended from the center of the upper wall of the hollow lid 20 into the lift stand 46. When the lid 20 is coaxially set on the lift stand 46, the cam shaft is spline-engaged with the cam 24. The lift stand 46 incorporates a cam shaft driving mechanism 29 which is adapted to turn the cam shaft 28 through a predetermined angle. The cam shaft driving mechanism 29 and the cam shaft form a locking/unlocking mechanism. The wall of the opening 12 of the container body 10 has a recess 12A, with which the lock arm 25** is engaged.

Normally, the lift stand 46 is fitted in the opening 42 formed in the upper wall 41 of the gas purge box 40, so that it closes the opening 42 together with the seal ring 47 from inside.

When, under this condition 10, the closed container is placed on the container stand 43 of the gas purge box 40, a sensor (not shown) detects it to activate the locking/unlocking mechanism, so that the lock arm 25 is disengaged from the recess **12*a* formed in the wall of the opening 24, and the lid 20 is therefore disengaged from the container body 10. When, under this condition, the lift stand 46 is lowered slightly, the opening 42 is opened; that is, it is communicated with the inside of the box 40. Thereafter, the gas supplying valve 45A and the gas discharging valve 45B are opened, so that the nitrogen gas in the nitrogen gas cylinder 50 is allowed to flow through the gas supplying pipe 44A into the container body 10, while the gas in the container body 10 is caused to flow outside through the gas discharging pipe 44B. As a result, the container body 10** is filled with the nitrogen gas to a high concentration.

When a predetermined period of time has passed, or when the concentration of nitrogen gas in the container body 10 has increased to a predetermined value, the locking/unlocking mechanism operates to lock the lid 20 causing the lock arm 25 to engage with the recess 12 in the wall of the opening 24. Thereafter, both the valves 45A and 45B are closed.

The gas purge unit of the invention is provided as one unit, and can be handled with ease. Therefore, it can be installed at desired positions in the clean room, or on devices in the clean room. This will eliminate the difficulty that, whenever the concentration of the nitrogen gas in the closed container is decreased, the closed container is transported to the semiconductor manufacturing equipment in the clean room, and gas-purged thereby, and then it is returned therefrom.

As was described above, the gas purge unit of the invention can be readily installed at desired positions in the clean room. This will eliminate the difficulty that, in purging a container of gas, only the semiconductor manufacturing equipment is used. In addition, the provision of the gas purge unit can eliminate the difficulty that uneconomically the closed container must be returned for purging it of gas. Thus, with the gas purge unit of the invention, the management of the closed container can be achieved readily when compared with the conventional art. Furthermore, an empty container, in which no wafer cassette is loaded yet, may be filled with inert gas. This treatment reduces the quantities of oxygen and moisture characteristic of the container when loaded with a wafer cassette.

What is claimed is:

1. A gas purge unit for conveying semiconductor wafers comprising:

a container including a container body having a flange extending about an opening of said container body, said container further including a lid adapted to extend across said opening so as to seal said container body;

locking means carried by said lid, said locking means being shiftable between a locked condition in which said lid is secured across the opening of said container and an unlocked condition;

a small integrally formed unitary purge box formed with an opening, said container body being adapted to be placed upon said purge box with the flange of said container body extending about the opening of said purge box;

a container stand located in said purge box, said container stand including a flange adapted to sealingly engaged said purge box about the opening thereof;

lifting means for moving said container stand and said lid within said purge box, said lifting means including means for shifting said locking means between said locked and unlocked conditions, said lifting means being located entirely within said purge box;

a gas supplying inlet formed in said purge box, said gas supplying inlet being located at the opening of said purge box, between the flange of said container stand when the flange is positioned about the opening of said purge box and said lid when said lid extends across the opening of said container; and a gas discharge outlet formed in said purge box, said gas discharge outlet being located at the opening of said purge box, between the flange of said container stand when the flange of said container stand is positioned about the opening of said purge box and said lid when said lid extends across the opening of said container.

2. The gas purge unit as claimed in claim 1, wherein said shifting means positions said locking means in said unlocked condition and said lifting means slightly lowers said container stand and said lid, such that said purge box is in fluid communication with said container, during purging of said container.

3. A gas purge unit as claimed in claim 1, wherein said purge box is portable.

4. A gas purge unit as claimed in claim 1, wherein said purge box is dedicated solely to purging said container.

5. A gas purge unit as claimed in claim 1, wherein said purge box further comprises six integrally formed walls, a first of said walls being formed with the opening of the purge box therein and a second of said walls being located opposite said first wail, said lifting mechanism further comprising a base mounted on said second wall, said base being located directly opposite said opening.

* * * * *